United States Patent [19]

Skinner

[11] 4,189,633

[45] Feb. 19, 1980

[54] FLEXING DEVICE FOR HOLDING A SURFACE ELECTRIC HEATING ELEMENT IN A RAISED POSITION

[75] Inventor: Charles A. Skinner, Columbia, Md.

[73] Assignee: Electro-Therm, Inc., Laurel, Md.

[21] Appl. No.: 914,874

[22] Filed: Jun. 12, 1978

[51] Int. Cl.[2] ..... H05B 3/68

[52] U.S. Cl. ..... 219/458; 219/407; 219/463; 219/467

[58] Field of Search ..... 219/404, 452, 460, 461, 219/462, 467, 415–419, 432, 433, 458, 518, 443, 444, 447, 455, 458, 459, 463, 467, 468, 524; 24/73 B, 81 B

[56] References Cited

U.S. PATENT DOCUMENTS

| | | | |
|---|---|---|---|
| 1,998,330 | 4/1935 | Nicholson et al. | 219/461 |
| 2,231,153 | 2/1941 | Camiener | 24/73 B |
| 2,508,552 | 5/1950 | Tuttle | 219/463 |
| 3,171,949 | 3/1965 | McOrlly | 219/467 |
| 3,482,079 | 12/1969 | Hurko | 219/463 |

*Primary Examiner*—Bruce A. Reynolds
*Assistant Examiner*—Bernard Roskoski
*Attorney, Agent, or Firm*—Low & Low

[57] ABSTRACT

The flexing device comprises a strip of metal adapted to be secured to the underside of a drip pan in which a planar formation of a surface electric heating element is disposed. Terminal legs and portions connecting the terminal legs to the planar formation pass through apertures in the bottom of the drip pan and are engaged by the flexing device. A base portion of the flexing device is secured to the center of the underside of the pan. First and second arms of the flexing device extend from the base portion of the flexing device and frictionally and resiliently engage the terminal legs and connecting portions. The second arm is struck from the base portion and is bent outwardly from the base portion to provide an open space which is aligned with the aperture for one terminal leg and connecting portion. The second arm has a first section extending at an angle from the base portion, a V-shaped bend and a second section extending at an angle toward the plane of the base portion. A tab is struck from the second section to provide an open space which is aligned with the aperture for the other terminal leg and connecting portion. The second arm, the tab and the V-shaped bend frictionally and resiliently engage the terminal legs and connecting portions for holding the heating element in a raised position.

8 Claims, 6 Drawing Figures

FLEXING DEVICE FOR HOLDING A SURFACE ELECTRIC HEATING ELEMENT IN A RAISED POSITION

BACKGROUND OF THE INVENTION

1. Field of the Invention

The field of the invention is surface electric heating element assemblies and more particularly a flexing device for engaging terminal legs and connecting portions of a surface electric heating element for holding the element in a raised position.

2. Description of the Prior Art

Heretofore, various hinge mechanisms and pivoting mechanisms had been proposed for engaging the terminal legs of an electric heating element. Examples of such pivot and hinge mechanisms can be found in the following patents:

| U.S. PAT. NO. | PATENTEE |
|---|---|
| 2,918,560 | Kruse |
| 3,171,946 | Ammerman |
| 3,171,947 | McOrlly |
| 3,213,266 | Kirschke |
| 3,248,518 | Ogle Jr, et al |
| 3,875,371 | Skinner |

In the use of a surface electric heating assembly, it is oftentimes desirable to be able to raise the heating element above the drip pan and to provide some mechanism for holding the element in the raised position while the drip pan is cleaned of debris and other matter which may have collected therein. An example of such a mechanism is disclosed in the Kirschke U.S. Pat. No. 3,213,266. In this U.S. Patent a surface electric heating element and reflector pan are hingedly mounted to a horizontal cooking surface. The terminal legs of the heating element extend through a flexible diaphragm. The diaphragm is flexed outwardly of a recess in the cooking surface when the heating element assembly is in a lower cooking position and is flexed through and into the recess in the cooking surface when the heating element assembly is raised thereby to hold the heating element in a raised position.

As will be described in greater detail hereinafter, the flexing device of the present invention provides a simple flexible device for engaging the terminal legs and the portions which connect the terminal legs to the planar formation of a heating element and for resiliently and frictionally engaging the terminal legs and connecting portions when and as the heating element is raised, for holding the heating element in a raised position.

SUMMARY OF THE INVENTION

According to the invention there is provided for use in a surface electric heating element assembly of the type including a drip pan and an electric heating element which is positioned in the pan, the element comprising a first, short terminal leg at one end and a second, longer terminal leg at the other end, the two legs extending generally parallel to each other with the ends thereof being generally in alignment with each other, the element further comprising a planar formation situated in a plane parallel spaced from the plane of the legs, a first connecting portion extending from the short leg to the outer end of the planar formation and a second connecting portion extending from the second leg to the inner end of the planar formation and the pan having passage means therethrough through which the connecting portions and terminal legs can extend for positioning the legs beneath the pan when the planar formation is disposed in the pan, flexing means adapted to be attached to the bottom of the pan in a position for flexibly engaging the terminal legs and connecting portions of the element, and when they are moved, frictionally and resiliently to engage them for holding the planar formation in a raised position.

DESCRIPTION OF THE PREFERRED EMBODIMENT

Figure 1:
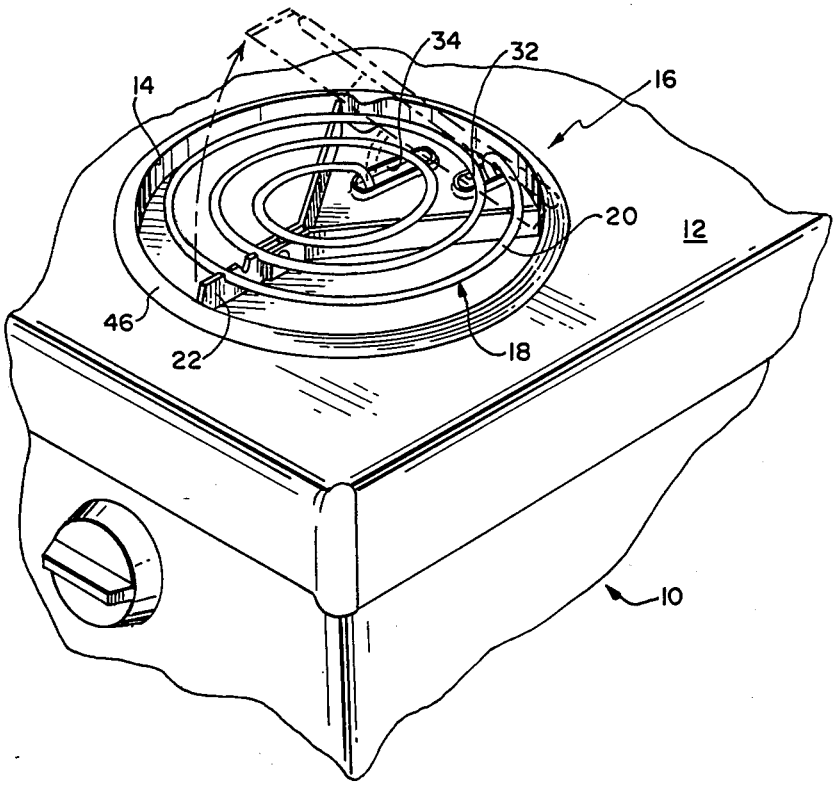
FIG. 1 is a fragmentary perspective view of a heating element assembly at the corner of an electric range with the spiral planar formation of the heating element situated in a drip pan of the heating element assembly.
Figure 3:
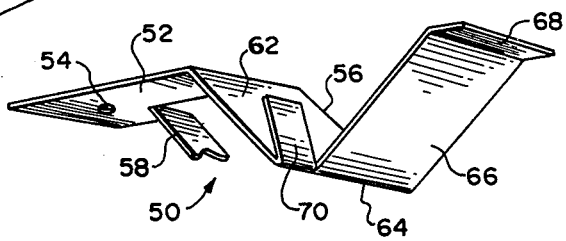
FIG. 3 is a perspective view of the flexing device of the present invention.

Referring now to the drawings in greater detail, there is illustrated in FIG. 1 a corner of an electric range 10 having an upper cooking surface 12. The upper cooking surface 12 has an opening 13 (FIG. 3) therethrough in which is positioned a drip pan 14 forming part of a heating element assembly generally identified by the reference numeral 16.

The heating element assembly 16 further includes a surface electric heating element 18 having a spiral planar formation 20 which is supported on a spider member 22 within the drip pan 14. The heating element 18 also includes a first, short terminal leg 24 (FIG. 2) connected by a connecting portion 26 to the outer end of the spiral planar formation 20 and a second, longer terminal leg 28 connected by a connecting portion 30 to the inner end of the spiral planar formation 20.

Figure 2:
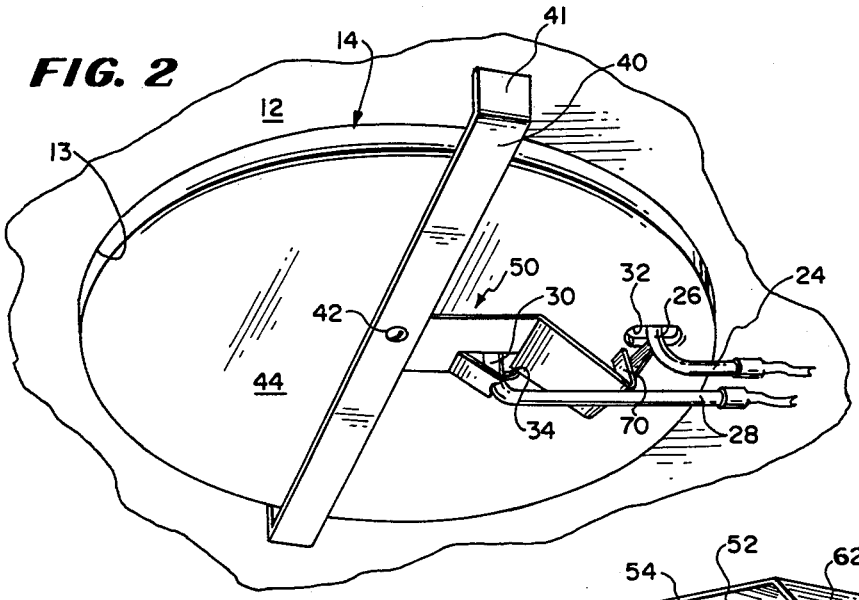
FIG. 2 is a perspective view of the underside of the drip pan and shows the flexing device of the present invention.

As shown in FIGS. 1 and 2, the drip pan 14 has two elongate apertures 32 and 34 which provide respective passage means through the drip pan for the terminal legs 24 and 28 and the connecting portions 26 and 30.

As shown in FIG. 2, the terminal legs 24 and 28 are generally aligned with each other and lie in a plane which extends beneath the drip pan 14 and which is in generally parallel spaced relation to the plane of the spiral planar formation 20.

Figure 4:
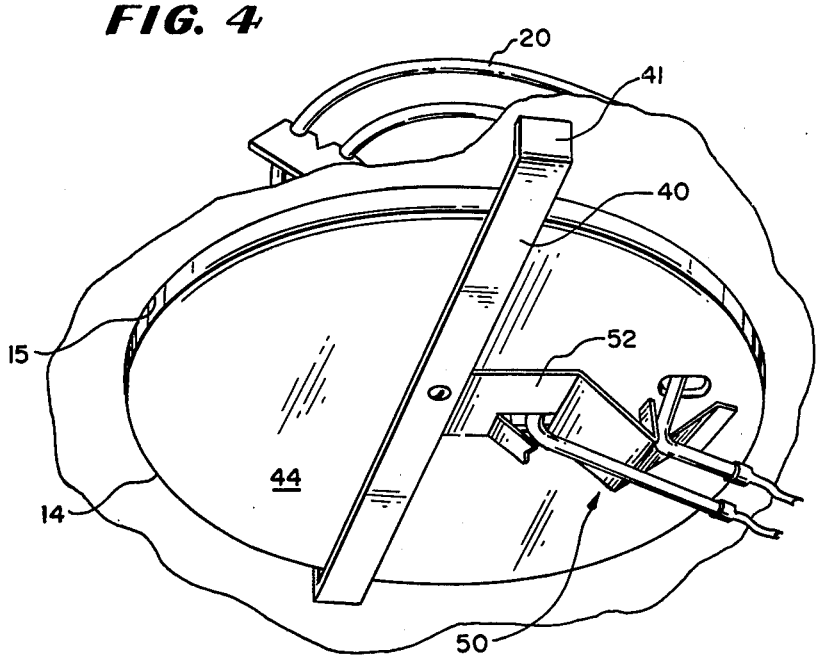
FIG. 4 is a perspective view of the underside of the drip pan similar to FIG. 3 but showing the terminal legs rotated downwardly to place the spiral planar portion of the heating element in a raised position.

Referring now to FIGS. 2 and 4, a U-shaped mounting bar 40 with short end legs 41 is secured to the underside of the drip pan 14 by a fastener 42 to hold the same at the center of the drip pan 14. The bar 40 has a length which is greater than the diameter of the drip pan and the short outer legs 41 at each end of the bar 40 engage the underside of the cooking surface 12. As shown in FIG. 1, the drip pan 14 has a rim 46 which engages the cooking surface 12 about the opening 13 therein. The legs 41 bearing on the underside of the cooking surface 12 together with the rim 46 engaging the upper side of the cooking surface 12 serve to hold the drip pan in place in the opening 13 in the cooking surface 12.

In accordance with the teachings of the present invention, a flexing device 50 is secured to the underside 44 of the drip pan 14. Preferably, this is achieved by fixing the flexing device 50 by means of the fastener 42 to the center of the underside 44 of the drip pan 14.

The flexing device 50 is made from a unitary strip of spring steel and can also be referred to as a spring clip or hinge clip. As shown, the flexing device 50 includes a base portion 52 which has an aperture 54 through which the fastener 42 is received for securing the base portion 52 adjacent the undersurface 44 of the drip pan 14. Extending from the base portion 52 is a first arm 56 and a second arm 58. Actually, the second arm 58 is struck from the base portion 52 and extends angularly downwardly from the base portion 52. Also, the open space formed beneath the second arm 58 in the base portion 52 is adapted to be aligned in registry with the aperture 34 through which the second leg 28 and second connecting portion 30 extend. As shown, the distal end of the first arm 58 is concave and has an arc of curvature approximately the same as the arc of curvature of the cross section of the second terminal leg 28 and second connecting portion 30.

The first arm 56 includes a first section 62 which extends angularly downwardly from the base portion 52 to a V-shaped bend 64. Extending upwardly from the V-shaped bend 64 is a second section 66 of the second arm 56. This second section 66 extends to the plane of the base portion 52 and has a flange 68 at the end thereof which lies in the plane of the base portion 52. Also, a tab 70 is struck from the second section 66 to provide open space on one side of the second section 66 which is adapted to be aligned in registry with the aperture 32 for the first terminal leg 24 and the first connecting portion 26.

Figure 5:
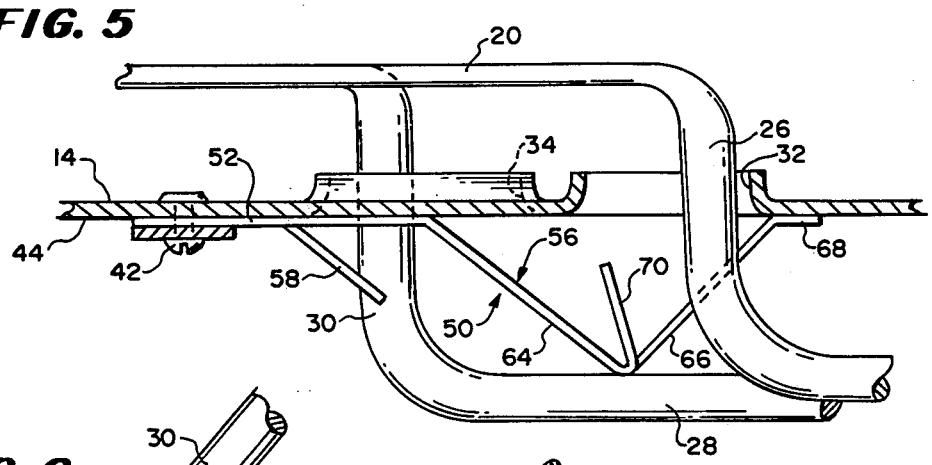
FIG. 5 is a fragmentary vertical sectional view through a portion of the drip pan adjacent the flexing device, when it is in the position shown in FIG. 2.

Referring now to FIGS. 2 and 5, it will be apparent that when the heating element 18 is is a lower cooking position with the spiral planar portion 20 resting on the spider 22 in the drip pan 14, the spiral planar portion 20 is generally parallel to the plane of the bottom of the drip pan 14 and the terminal legs 24 and 28 extend beneath the drip pan 14 in a plane parallel to the plane of the spiral planar formation 20. In this position, the second arm 58 of the flexing device 50 bears against the connecting portion 30 and frictionally and resiliently engages the same. Also the V-shaped bend 64 frictionally and resiliently engages the second terminal leg 28.

Figure 6:
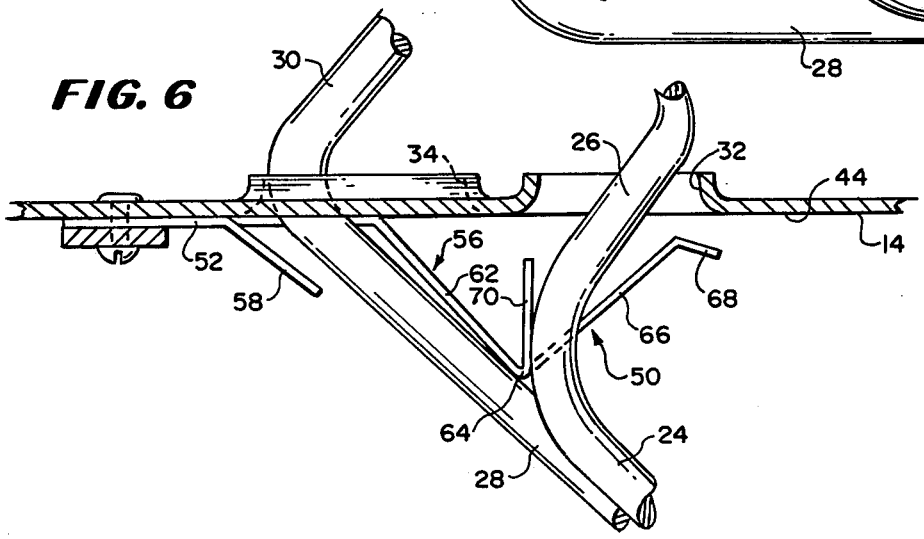
FIG. 6 is a fragmentary vertical sectional view through a portion of the drip pan adjacent the flexing device where it is in the position shown in FIG. 4.

Then, with reference to FIGS. 4 and 6, when the spiral planar formation 20 of the heating element 18 is raised, the bend between the first connecting portion 26 and the first terminal leg 24 engages the tab 70 while at the same time the second terminal leg 28 engages the V-shaped bend 64 and the first section 62 of the first arm 56. This frictional and resilient engagement of these portions of the flexing device 50, namely, the tab 70 and the first section 62 of the first arm, against the terminal leg 24 and the terminal leg 28 serves to hold the heating element 18 in a raised position where the spiral planar portion 20 extends upwardly at an angle from the plane of the bottom of the drip pan 14. In this way, with the planar formation 20 in a fixed raised position, one can reach into the drip pan 14 and clean the same without having to hold the planar portion 20 in an upright position.

From the foregoing description it is apparent that the flexing device 50 of the present invention has a number of advantages, some of which have been described above, and other of which are inherent in the invention. Also obvious modifications and variations can be made to the flexing device 50 without departing from the teachings of the present invention. Accordingly, the scope of the present invention is only to be limited as necessitated by the accompanying claims.

I claim:

1. In a surface electric heating element assembly of the type including a drip pan and an electric heating element, which is positioned in the pan, the element comprising a first, short terminal leg at one end and a second, longer terminal leg at the other end, the two legs extending generally parallel to each other with the ends thereof being generally in alignment with each other, the element further comprising a planar formation situated in a plane parallel spaced from the plane of the legs, a first connecting portion extending from the short leg to the outer end of the planar formation and a second connecting portion extending from the second leg to the inner end of the planar formation and the pan having passage means therethrough which the connecting portions and terminal legs can extend for positioning the legs beneath the pan when the planar formation is disposed in the pan, the improvement comprising flexing means adapted to be attached to the bottom of the pan, said means including strip-like portions disposed in a position for flexibly engaging the terminal legs and connecting portions of the heating element in a lowered position and, when they are moved to a raised position, said strip-like portions frictionally and resiliently engaging said legs and element for holding the planar formation in a raised position.

2. The flexing means improvement according to claim 1 comprising a unitary strip of flexible metal adapted to be attached at one end to the underside of the drip pan.

3. The flexing means improvement according to claim 1 including a base portion thereof adapted to be attached to the drip pan and said strip-like portions include first and second parallel arms which extend generally parallel to each other from the base portion.

4. The flexing means improvement according to claim 3 wherein the first arm has a first section extending from the plane of the base portion, a V-shaped bend at the outer end of said first section and a second section extending from said V-shaped bend toward said plane of said base portion, said V-shaped bend being adapted and arranged frictionally and resiliently to engage the second terminal leg as the element is raised and said first section being adapted and arranged frictionally and resiliently to engage the second terminal leg when the heating element is in a raised position.

5. The flexing means improvement according to claim 3 wherein the second arm is struck from said base portion to provide an open space which is adapted to be arranged in registry with the passage means for the second terminal leg and second connecting portion.

6. The flexing means improvement according to claim 5 wherein said second arm extends outwardly from said base portion and the distal end of said second arm has a concave shape with an arc of curvature approximately the same as the arc of curvature of the cross section of the second terminal leg, said distal end being adapted and arranged frictionally and resiliently to engage the connecting portion of the second terminal leg when the planar formation of the heating element is disposed in the drip pan.

7. The flexing means improvement according to claim 4 wherein said second section of said first arm has a tab struck therefrom to provide an open space which is adapted to be arranged in registry with the passage means for the first terminal leg and first connecting portion, said tab extending from the V-shaped bend toward said plane of said base portion and being adapted and arranged frictionally and resiliently to engage the connecting portion of the first terminal leg when the heating element is raised.

8. The flexing means improvement according to claim 4 wherein said second section of said first arm has a flange at the outer end thereof which extends at an angle from said second section and which lies in the plane containing said base portion, said flange being adapted to bear against the underside of the pan when the planar portion is disposed in the pan.

* * * * *